United States Patent [19]

Ishiwata et al.

[11] 4,358,523

[45] Nov. 9, 1982

[54] FILM UNITS FOR PHOTOGRAPHY OF DIFFUSIVE TRANSFER PROCESS TYPE

[75] Inventors: Mamoru Ishiwata, Larchmont, N.Y.; Minoru Minoda, Hadano, Japan

[73] Assignee: Fuji Photo Film Co., Ltd., Kanagawa, Japan

[21] Appl. No.: 191,623

[22] Filed: Sep. 29, 1980

[30] Foreign Application Priority Data

Sep. 27, 1979 [JP] Japan ..... 54-124935

[51] Int. Cl.[3] ..... G03C 1/48

[52] U.S. Cl. ..... 430/207; 430/499; 430/496

[58] Field of Search ..... 430/207, 499, 498, 496

[56] References Cited

U.S. PATENT DOCUMENTS 4,242,443 12/1980 Lührig et al. ..... 430/207

FOREIGN PATENT DOCUMENTS 29-124934 9/1954 Japan .
48-33697 10/1973 Japan .
50-153628 5/1975 Japan .
1330524 10/1970 United Kingdom .

OTHER PUBLICATIONS

Research Disclosure, 78 RD#17321, Sylvester et al.

*Primary Examiner*—John E. Kittle
*Assistant Examiner*—John L. Goodrow
*Attorney, Agent, or Firm*—Sughrue, Mion, Zinn, Macpeak & Seas

[57] ABSTRACT

In a film unit for photography of the diffusive transfer process type including a photosensitive sheet, a mask defining an image border definition with an aperture provided therein, a pod for a processing liquid, etc., bordering portions of the photosensitive sheet underlying the image border definition are formed of dried dummy liquid layers in place of the normal layers constituting the photosensitive sheet.

4 Claims, 9 Drawing Figures

FILM UNITS FOR PHOTOGRAPHY OF DIFFUSIVE TRANSFER PROCESS TYPE

BACKGROUND OF THE INVENTION

This invention relates to a film unit, which is used for the photography of the multicolor diffusive transfer process type, and more particularly, to a construction of the border of such an image area of a photosensitive laminate as defined by an aperture in a mask constituting the film unit.

Conventionally, in film units for use in the photography of the multicolor diffusive transfer process type (hereinafter referred to as a film unit), there have already been proposed various types of film units as can be found in Japanese Patent Publication (Tokkoshoh) 48-33697, Japanese Laid Open Patent Application (Tokkaishoh) No. 48-43317, Japanese Laid Open Patent Application (Tokkaishoh) No. 50-153628, Japanese Laid Open Patent Application (Tokkaishoh) No. 52-11027, etc. However, their constructions are basically not very different, and a typical type is shown in FIGS. 1 and 2 of the accompanyings. FIG. 1 is a perspective view of the film unit of the typical type, while FIG. 2 is an exploded view showing the disassembled state of the components, in which the pod and trap ends have not been folded over yet. As can be seen from these FIGS. 1 and 2, the film unit comprises a photosensitive sheet 1 including a plurality of layers in sequence, which are necessary for an image forming process, a tranparent cover sheet 2, a mask 3 defining an image border with an aperture provided therein, a rupturable container or pod member 4 containing an aqueous processing liquid, a trap member 5 capable of retaining therein the surplus processing liquid after the diffusion transfer process and a pair of spacers 6 for use in regulating the thickness of the processing liquid spread over a layer constituting the photosensitive sheet 1. More specifically, according to such film unit as stated hereinabove, the photosensitive sheet 1 comprising layers each having the same dimensions and composed of processing material for its full dimension has applied thereon the following in sequence; i.e. the mask 3 having a rectangular aperture defining the image area, the respective pod member 4 and trap member 5 on both transverse aperture-bordering planes 3*d*, 3*c* of the mask 3, the paired spacers 6, 6 on both sides of lateral aperture-bordering planes 3*a*, 3*b* of the mask 3 and the transparent cover sheet 2. Accordingly, mask 3, the paired spacers 6, 6, respective pod member 6 and the trap member 5 are sandwiched between the cover sheet 2 and the photosensitive sheet 1, in which the pod and the trap ends of the mask 3 are both folded over in a manner such that these can make the respective pod and trap with respective subsidiary members 4 and 5. The consequent construction of the film unit causes a discharge of the pod's contents to be effectively spread over the photosensitive sheet 1, when subjected to pressure, with a self-processing photographic function being executed.

However, such conventional film units as described hereinabove have the following disadvantages in manufacturing operation and in quality, since the entire region of the photosensitive sheet 1, which relatively faces the cover sheet 2, is composed of several image processing layers.

(1) As can be seen from FIG. 2, such a portion of the photosensitive sheet 1 as covered by the mask 3 (especially, respective portions each superposed thereon either by the bordering plane 3*d* for construction of the pod or by the bordering plane 3*c* for construction of the trap) does not serve for the image formation of the self-processing functioning nature. Accordingly, this portion (approximately 37% of the entire area of the photosensitive sheet 1, according to the calculation of the present inventors) is substantially of no use. Although, the detail is specifically described hereinafter, the photosensitive materials required for image formation processing are respectively composed of various kinds of coloring agents, photographic emulsions, etc. Since such materials are commonly composed of such expensive elements as silver or the like, it is to be noted here that the materials required for the above purpose are commonly rather expensive.

(2) When the mask 3 is applied upon the photosensitive sheet 1, a heat-sensitive bonding agent is conventionally used. Such being the case, the mask 3 is superposed on the photosensitive sheet 1 and, is thermally stuck thereon by a heater with a lattice-shaped heating face thereon. As a result, as can be seen in FIG. 3, lattice-shaped heat seal marks 7, which correspond to the structural feature of the heating face of the heater are caused on the plane 3*d* ready for construction of the pod (when seen from the side of the photosensitive sheet 1).

(3) In the thermal bonding operation between the photosensitive sheet 1 and the mask 3, it is substantially difficult to completely seal the entire faces to be bonded. This means some unsealed portions remain therebetween. Subject to such undesirable sealing condition, the processing liquid may permeate through the unsealed portions, with a result that stripes 8 caused by uneven concentration are effected along the image border definition on the photosensitive sheet 1 as shown in FIG. 3.

(4) Since the mask 3 is superposed on the photosensitive sheet 1, there can be effected stepwise portions on the photosensitive sheet 1 along the aperture of the mask 3 (i.e. the irregularities occurring along the aperture borders). Hence, when a discharge of the pod's contents (the pod per se is not shown here) is forcibly effected in the direction of the arrows as shown in FIG. 4, air, which has been retained inside the portion between the mask 3 and the sheet 1, is not effectively discharged and thus, involved in the discharge flow, with a result of generation of air bubbles 9 in the stepwise portion. Since the portions of the photosensitive sheet 1 having bubbles thereon are left unprocessed, black dots or black dashes 10 as shown in FIG. 3 are effected along the image border definition on the photosensitive sheet 1.

Recently, in order to especially eliminate the risk of any irregularities occurring along the aperture border, Research Disclosure 78. RD. 17321 discloses several methods for improving the image border definition. According to one embodiment, two opaque and fluid-impervious stripes (carbon-impregnated acrylic material, for example) are applied on the emulsion side of image-receiving member. More specifically, as shown in FIG. 5 of the present drawings, respective stripes 11 are applied on the portions, each superposed thereon, either by the bordering plane 3*d* for construction of the pod or by the bordering plane 3*c* for construction of the trap as described earlier. However, to provide such layers 11 as described above, materials and additional manufacturing steps are correspondingly required, thus resulting in higher manufacturing cost of the film unit.

As is clear from the description in the foregoing, the conventional film unit has such disadvantages not only as the manufacturing cost is high due to its noneffective use of the expensive photosensitive material, but also as the consequent photographic products are deteriorated in image quality on the periphery of the image area defined by the aperture in the mask, and such disadvantages have to be eliminated.

SUMMARY OF THE INVENTION

Accordingly, an essential object of the present invention is to provide a film unit for photography of the diffusive transfer process type, which is adapted to have a construction capable of eliminating any consequent deterioration in image quality especially caused on the periphery of an image area definition.

Another important object of the present invention is to provide a film unit of the above described type, which is further adapted to have such a construction that a rather expensive photosensitive sheet is effectively provided only for a substantial image area, to thereby exclude non-ecconomacal use of expensive photosensitive materials.

A further object of the present invention is to provide a film unit of the above described type, which is simple in construction and, which is highly efficient in use.

In accomplishing these and other object according to one preferred embodiment of the invention, there is provided a film unit for photography of the diffusive transfer process type as will be described hereinbelow. The film unit includes a photosensitive sheet comprising a plurality of laminated layers, each contributing to a self-processing photographic function, and which has applied thereon by the following, in sequence; i.e. a mask defining an image border definition with an aperture therein, a pod member containing therewith a processing liquid and being capable of releasing the processing liquid when subjected to pressure, a trap member capable of retaining therewith the surplus processing liquid after the diffusive transfer process a pair of spacers for use in regulating the thickness of the liquid to be discharged over the photosensitive sheet and a transparent cover sheet. At least a partial portion of the photosensitive sheet underlying around the image border definition area is formed by at least one dried dummy liquid layer taking no part in the self-processing photographic function in place of a portion of at least one of the layers performing the self-processing photographic function. Furthermore, according to a further modified embodiment, the at least partial portion of the dried dummy liquid layer is adapted to be extended inside a relative definition area corresponding to the image border definition, so that a substantial image area is not fully defined by the aperture of the mask, but is substantially defined with the help of a boundary effected between the at least one dried dummy liquid layer and its adjacent at least one layer performing the self-processing photographic function. By the arrangement of the latter modified embodiment, the present invention can provide a film unit having a specific construction, which makes it possible to eliminate any consequent deterioration in image quality especially caused on the periphery of the image definition area and, through which the rather expensive photosensitive laminate is substantially provided only for a substantial image area.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
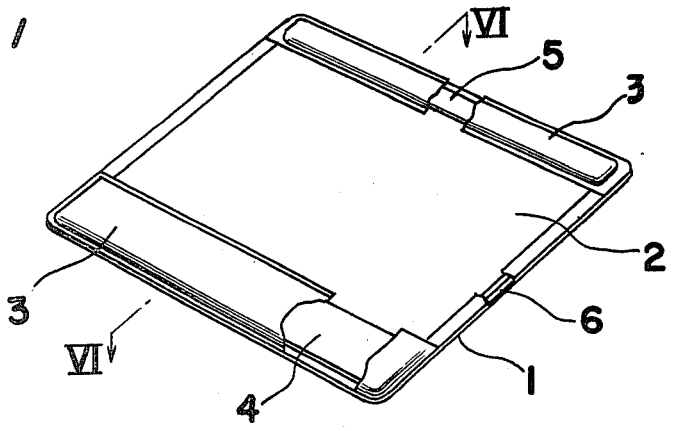
FIG. 1 is a perspective, partially exploded view of a film unit of the typical type.
Figure 2:
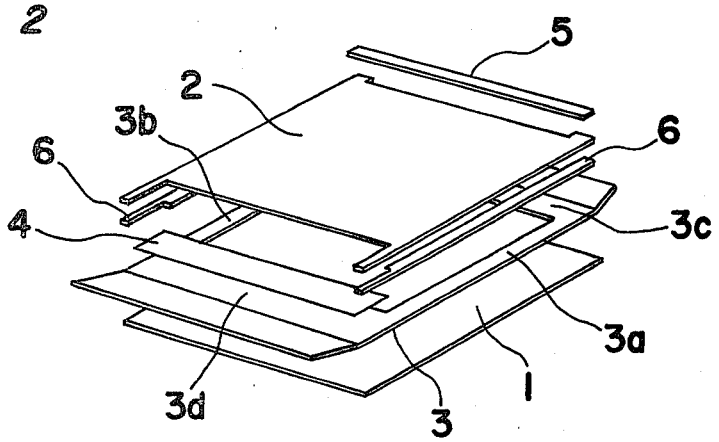
FIG. 2 is an exploded view showing the disassembled relationship of the components of the film unit shown in FIG. 1.
Figure 3:
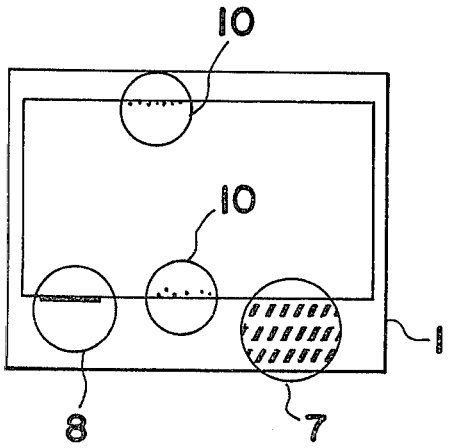
Fig. 3 (PRIOR ART)
FIG. 3 is a plain view of a film unit having the conventional construction, particularly showing some deficiencies which are inherently accompanied when such film unit is employed.
Figure 4:
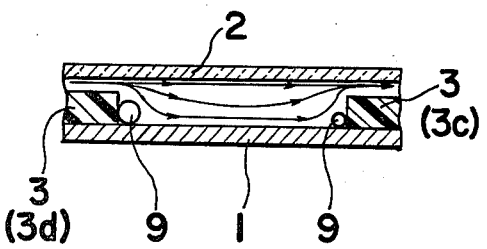
Fig. 4 (PRIOR ART)
FIG. 4 is a partial, cross sectional view of the film unit shown in FIG. 3, particularly illustrating the feature of involvement of air bubbles in accordance with the discharge of a processing liquid on a photosensitive sheet.
Figure 5:
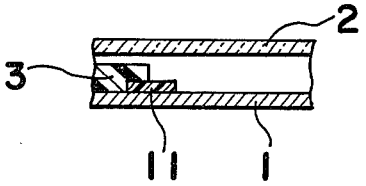
Fig. 5 (PRIOR ART)
FIG. 5 is a partial, cross sectional view of another embodiment of the film unit shown in FIG. 3, which is particularly modified to prevent the occurrence of the involvement of the air bubbles.
Figure 6:
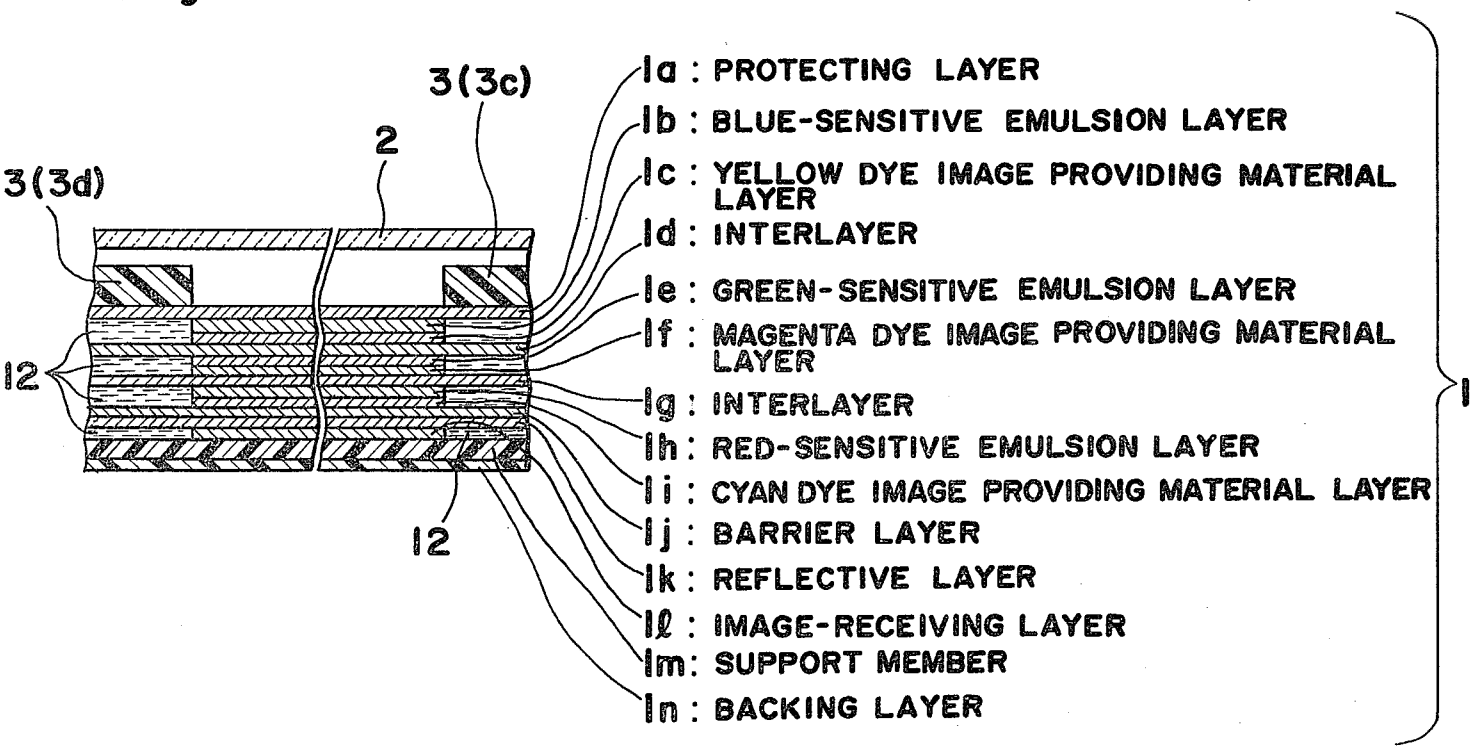
FIG. 6 is a partial, cross sectional view of a film unit in accordance with one preferred embodiment of the present invention with the various components greatly magnified for purposes of illustration only, which corresponds to a cross sectional view taken along the line VI—VI of FIG. 1.

Referring now to FIG. 6 of the accompanying drawings, there is shown a partial, cross sectional view of a film unit in accordance with one preferred embodiment of the invention with the various components greatly enlarged for purposes of illustration only, which corresponds to a cross sectional view taken along the line VI—VI of FIG. 1. The film unit comprises a cover sheet 2, a mask 3, a photosensitive sheet 1 comprising a plurality of layers designated by numeral 1*a* to 1*n*, and a plurality of dried dummy liquid layers 12 each taking no real part for image formation processing. The photosensitive sheet 1 comprises in sequence a protecting layer 1*a*, a blue-sensitive emulsion layer 1*b*, a yellow dye image providing material layer 1*c*, an interlayer 1*d*, a green-sensitive emulsion layer 1*e*, a magenta dye image providing material layer if, an interlayer 1*g*, a red-sensitive emulsion layer 1*h*, a cyan dye image providing material layer 1*i*, a barrier layer 1*j*, a reflective layer 1*k*, an image-receiving layer 1*l*, a support member 1*m* and a backing layer 1*n*, respectively.

According to such film unit as shown in FIGS. 1 and 6, not only such layer construction of the photosensitive sheet 1 as comprising the layer of 1*a* to 1*n* as described above, but also the self-processing photographic functioning caused by these layers have already been well known to those skilled in the art. Namely, with respect to the self-processing photographic functioning, in accordance with a discharge of a processing liquid between the cover sheet 2 and the outermost surface of the protecting layer 1*a*, the processing liquid permeates and is transferred, by diffusion, from the blue-sensitive emulsion layer 1*b* through the reflective layer 1*k* to the image-receiving layer 1*l* thereby to provide a positive dye image therein, the details of which are well known through a number of disclosures, e.g. in the description of British Pat. No. 1,330,524 and thus, herein omitted for the sake of the brevity.

In short, according to such construction of the photosensitive sheet, three grouped layers i.e. the dye image providing material layer group of yellow 1*c*, magenta 1*f* and cyan 1*i*, the color-sensitive emulsion layer group of red 1*b*, green 1*e* and red 1*h*, and the image-receiving layer 1 are essential for the image formation processing (subject to the necessity, respective interlayers 1*d* and 1*g* can be included), thus these three groups, as a whole, are especially referred to the so-called necessary image forming layers.

In contrast, according to one preferred embodiment of film units of the invention, there are provided a plurality of dried dummy liquid layers 12, each of which does not take part in the self-processing photographic function. The respective dummy liquid layers are comprised of respective portions of the photosensitive sheet 1 underlying an image border definition area, which is defined by an aperture of the mask 3 (especially, respective portions each superposed thereon by either of the bordering plane 3*d* for construction of the pod and the bordering plane 3*c* for construction of the trap). In the embodiment shown in FIG. 6, a first dried dummy liquid layer 12 is transversely interposed between the protecting layer 1*a* and the interlayer 1*d*. A second dried dummy liquid layer 12 is transversely interposed between the interlayer 1*d* and the interlayer 1*g*, while a third dried dummy liquid layer 12 is transversely interposed between the interlayer 1*g* and the barrier layer 1*l*. A fourth dried dummy liquid layer 12 is transversely interposed between the reflective layer 1*k* and the support member 1*m*.

As far as a liquid to be contained in the dried dummy liquid layer is concerned, such liquids, each approximating the same liquid properties with anyone of respective liquids each defining the photosensitive layer, is preferable. However, the dummy liquid is not allowed to apply any bad influence upon the photographic properties. By way of example, the dummy liquid can be selected from one aqueous solutions of gelatin, soluble polymers including, for example, polyvinyl alcohol, deacetyl cellulose, methyl cellulose and the like. However, a gelatin aqueous solution is most preferable. When the dummy liquid is applied to the photosensitive sheet 1 so as to constitute respective dried dummy liquid layers, there may be a possibility that a disturbance or disorder can be caused along each of boundaries (i.e. the boundary between the dried liquid layer and its adjacent emulsion layer, or its adjacent dye image providing material layer, or its adjacent image-receiving layer) through an interflow of materials each having been layered of both sides of the boundary. However, subject to the condition that the liquid properties (including the liquid viscocity, specific gravity, surface tension etc.) and liquid amount of the dummy liquid are adjusted by taking into consideration respective characteristics of these emulsion, dye image providing material etc., there is not much fear of the occurrence of such disturbance as described above. According to the experiment carried out by the present inventors, the consequent disorder of the boundary, which is caused by the disturbance described above can be retained within ±0.5 mm variance from a rectilinear boundary. The details of the manufacturing process of the photosensitive sheet 1 of the invention will be described hereinbelow.

The photosensitive sheet 1 includes the support member 1*m*, which has thereon the respective layers 1*l*, 1*k*. . . 1*a* in sequence. These layers can be applied on the support member 1*m* through a conventional coating process such as an extrusion coating method, slide hopper coating method or the like.

Figure 7:
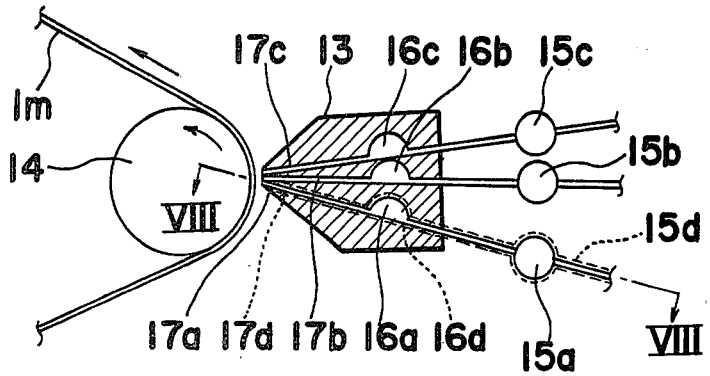
FIG. 7 is a schematic, partially cross sectional view of an extrusion apparatus, embodying the present invention.
Figure 8:
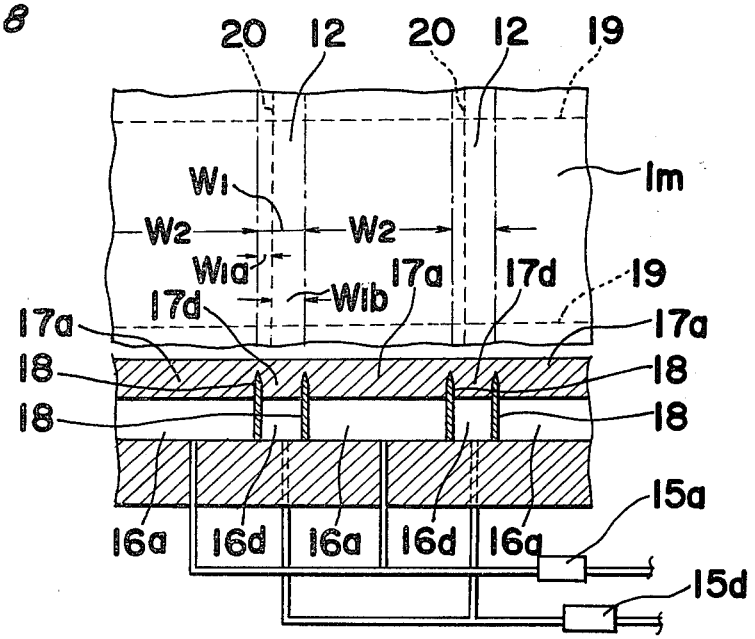
FIG. 8 is a partial, cross-sectional view, which is taken along the line VIII—VIII of FIG. 7.

In FIG. 7, there is shown an extrusion device injector 13 capable of simultaneously coating three layers, with which the photosensitive sheet 1 used in the practice of this invention was manufactured for one preferred embodiment of the present invention. FIG. 8 is a cross sectional view taken along the line VIII—VIII of FIG. 7, particularly showing relative spacing relationship between the layers coated on the support member 1*m* and the immediately adjacent dried dummy liquid layers 12.

As stated hereinabove, various coating methods have already been proposed. However, according to the embodiment as shown in FIGS. 7 and 8 of the present invention, twelve layers 1*a* to 1*l* can be laminated on the supporting member 1*m* by four coating operations. Namely, according to the present coating embodiment, there are provided four extrusion devices each disposed along a transferring passage of the supporting member 1*m* so as to accomplish simultaneous three-layer coating. Such being the case, the support member 1*m* has first superposed thereon, three layers of the image-receiving layer 1*l*, a reflective layer 1*k* and the barrier layer 1*j* in conjunction with the dried dummy liquid layers 12 on both sides of each of the image-receiving layers 1*l*. The same procedures are applicable for the following laminating steps, and finally, three layers of the yellow dye image providing material layer 1*c*, the blue-sensitive emulsion layer 1*b* and the protecting layer 1*a* in conjunction with the dried dummy liquid layers 12 on both sides of the respective yellow dye image providing material layer 1*c* and blue-sensitive emulsion layer 1*b* are superposed with a fourth extrusion device (not shown here).

Referring back to FIG. 7, the first coating step with the first extrusion device 13 is specifically described hereinbelow (i.e. the superposition of simultaneous coating of the respective image-receiving layers 1*l*, 1*l*, . . . , the respective reflective layers 1*k*, 1*k*, . . . and the respective layers 1*j*, 1*j*, . . . in conjunction with the respective dried dummy layers 12, 12 . . . on both sides of each of the image-receiving layers 1*l*, 1*l*, . . . on the support member 1*m*). An extrusion apparatus comprises at least one backing roll 14 transporting therewith, the support member 1*m* in a direction as denoted by an arrow (the support member 1*m* having been superposed on the backing layer 1*n* in advance through an independent operating step) and a plurality of the extrusion devices 13, in which each of the extrusion devices 13 comprises coating liquid supply pumps 15*a*, 15*b*, 15*c* and a dummy liquid supply pump 15*d* according to the embodiment shown in FIG. 7. The coating liquid supply pump 15*a* feeds a coating liquid for use in formation of the respective image-receiving layers 1*l*, 1*l*, . . . to respective slot portions 17*a*, 17*a*, . . . through reservoirs 16*a*, 16*a*, . . . . Similarly, the coating liquid supply pump 15*b* feeds a coating liquid for use in formation of the respective reflective layers 1*k*, 1*k*, . . . to respective slot portions 17*b*, 17*b*, . . . through reservoirs 16*b*, 16*b*, . . . , while the coating liquid supply pump 15*c* feeds a coating liquid for use use in formation of the respective barrier layers 1*j*, 1*j*, . . . to respective slot portions 17*c*, 17*c*, . . . through reservoirs 16*c*, 16*c*, . . . . The dummy liquid supply pump 15*d* feeds the dummy liquid to respective slot portions 17*d*, 17*d*, . . . through reservoirs 16*d*, 16*d*, . . . . The extrusion device 13 further includes separators 18, which are used for separating respective discharges of the coating liquid from respective discharges of the dummy liquid. Lateral width of the paired separators 18 and 18, and their spacing substantially regulate the lateral width $w_1$ of the dried dummy liquid layer and the lateral width $w_2$ of the image area, respectively, the situation of which is specifically shown in FIG. 8.

Furthermore, dotted lines 19 and 20 define respective lines, along which each photosensitive sheet portion is cut off from the rest, thereby providing the film units, each having predetermined dimensions, when the predetermined coating and drying steps thereof are accomplished. Since the relationship of $w_1 = w_{1a} + w_{1b}$ exists, it can be clearly understood that the width designated by $w_{1a}$ specifies the portion to be superposed thereon by the portion 3*c* for the trap, while the width designated by $w_{1b}$ specifies the portion to be superposed thereon by the portion 3*d* for the pod.

When the coating step of the photosensitive laminate is performed with such extrusion apparatus as described above, not only the layers of the respective image-receiving layers 1*l*, 1*l*, . . . , the respective reflective layers 1*k*, 1*k*, . . . and the respective barrier layers 1*j*, 1*j*, . . . , but also respective dummy layers on both sides of each of the image-receiving layers 1*l*, 1*l*, . . . are simultaneously effected. Moreover, as can be seen from the description hereinabove, respective thicknesses of the later can be regulated by controlling respective feeding rates of the liquid supply pumps 15*a*, . . . 15*d*, whereas respective lateral widths of the layers can be predetermined by regulating the respective lateral spacings of given paired separators 18 and 18, relative to the other paired separators.

Accordingly, such portions of the photosensitive sheet 1 as covered by the mask 3, especially respective portions each superposed thereon either by the bordering plane 3*d* for construction of the pod or by the bordering plane 3*c* for construction of the trap, are adapted to be comprised of the dummy liquid layers 12 as shown in FIG. 6. Hence, the present invention can provide film units of the diffusive transfer process type, with rather expensive image processing material layers being laminated only substantially the image area, thus resulting in economical use of expensive processing materials.

Figure 9:
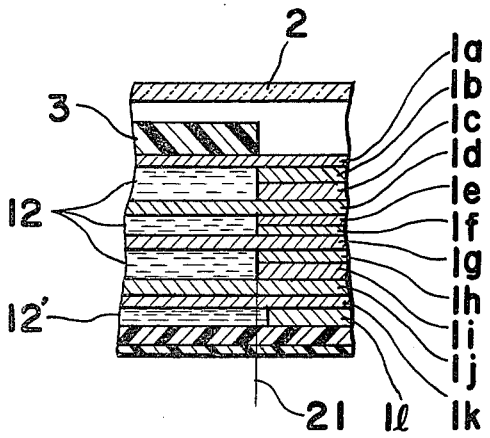
FIG. 9 is a partial, cross sectional view of one modified embodiment of the film unit shown in FIG. 6.

When the dried dummy layers 12 are provided, it is better to further introduce such arrangement as will be described hereinbelow, to eliminate a consequent deterioration in image quality especially caused on the periphery of the image border definition. Namely, as shown in FIG. 9, the dried dummy liquid layer 12 adjacent to be image-receiving layer (especially referred to by a numeral 12') is so arranged as to limit an over-all image area definition at its inner lateral side. Such being the case, the respective lateral end portions of the dried dummy liquid layers 12' lies somewhat inside of the image area definition which is defined by the aperture of the mask 3, in which as can be seen in FIG. 9, each of the respective lateral end portions of the dummy liquid layers 12' lies inwardly beyond a line 21 defining the aperture and is extrapolated toward the inside of the photosensitive sheet 1.

By the arrangement as described hereinabove, the image area definition is not controlled by the aperture of the mask 3, but by a boundary effected between the dried dummy liquid layer 12' and the image-receiving layer 1*l*. In short, the image area is substantially defined by the peripheries of the image-receiving layers 1*l* and 1*l*, while the photosensitive sheet 1 per se comprises a plurality of the layers. Accordingly, the consequent deterioration in quality, which has been caused by such undesirable involvement of air and/or permeation of the processing liquid as described earlier, is prevented from appearing in the presence of such type of dried dummy layers 12' and 12' as described above. With respect to a liquid to be included in the dried dummy liquid layer 12', a liquid of the non-mordant type is most preferable. Consequently, the present invention can provide film units for photography of the diffusive transfer process type, which are constructed so as to eliminate the consequent deterioration in image quality especially caused on the periphery of the image area defined by the aperture in the mask.

In the aforesaid embodiment, the present invention has been described with the help of such specific photosensitive sheet as to be manufactured through the process including the four-time coating steps. However, it is to be noted here that such embodiment is not critial, and various changes and modifications are apparent to those skilled in the art.

Furthermore, according to the present invention, the number of the dried dummy liquid layers 12 each constituting the photosensitive sheet in place of the image processing layers is not limited to be four. Thus, not only may a sole application of a single dried dummy liquid layer in connection with either of the image-receiving layer 1*l*, the respective emulsion layers 1*b*, 1*e*, 1*h* and the respective dye image providing material layers 1*c*, *1f*, 1*i*, be effected but also the combinational application thereof may be performed. Namely, the present invention can be accomplished, if the bordering portion of at least one layer, which is substantially necessary for the image formation processing, is substituted by the dried dummy liquid layer.

As a matter of fact, it is preferable that respective portions of the photosensitive sheet each being correspondingly superposed thereon by either of respective lateral bordering planes 3*a* and 3*b* of the mask 3, also comprise the dried dummy liquid layers 12, respectively. However, the sum of these regional areas is not so large relative to the entire area of the photosensitive sheet, and even to that of the respective portions 3*c* and 3*d*. Furthermore, the deterioration in image quality is most frequently effected in and around the bordering portions 3*c* and 3*d*. Due to the reasons stated above, it is sufficient that the respective portions of the photosensitive sheet, each superposed thereon by either by of the bordering portions 3*c* and 3*d*, comprise the dried dummy liquid layers for purposes of the invention.

In summary, according to the present invention, the following advantages are effected.

(1) The photosensitive sheet is provided substantially only for the image area, while the substantially non-image area is composed of the dummy liquid layers. Accordingly, the present invention has the advantage of excluding any loss in photosensitive materials, which is otherwise accomplished, and makes it possible to manufacture the film units at extremely low cost.

(2) Due to the construction of the film unit comprising the dried dummy liquid layers, heat seal marks are prevented, which are otherwise effected, when the mask is applied upon the photosensitive sheet.

(3) Substantially all of the image area is not fully defined by the aperture of the mask, but is substantially defined with the help of the boundaries effected between the dried dummy liquid layers and their adjacent at least one layer, which takes part in the self-processing photographic function. Accordingly, the consequent deterioration in image quality on the periphery of the image border definition i.e. the occurrence of the stripes caused by the uneven concentration, the linear or dotted dirt etc. which are caused by such undesirable involvement of air and/or permeation of the processing liquid as described earlier, can be effectively prevented from taking place.

Although the present invention has been fully described by way of example with reference to the accompanying drawings, it is to be noted here that various changes and modifications will be apparent to those skilled in the art. Therefore, unless otherwise such changes and modification depart from the scope of the present invention, they should be construed as included therein.

What is claimed is:

1. A film unit for photography of the diffusive transfer process type, which comprises a cover sheet and a photosensitive sheet, said photosensitive sheet including a plurality of laminated layers each taking part in a self-processing photographic function, said cover sheet and said photosensitive sheet having applied therebetween, a mask defining an image border definition with an aperture provided therein, a pod member containing therewith a processing liquid and being capable of releasing said processing liquid when subjected to pressure, a trap member capable of retaining therewith the surplus processing liquid after the diffusive transfer process, and a pair of spacers for use in regulating the thickness of the processing liquid to be discharged over said photosensitive sheet, the improvement wherein at least a partial portion of said photosensitive sheet underlying said image border definition comprises at least one dried dummy liquid layer extending inside or lying flush to a relative definition area corresponding to the image border definition which takes no part in the self-processing photographic function and which prevents the occurence of stripes, black dots or black dashes in the periphery of the image area.

2. A film unit for photography of the diffusive transfer process type as claimed in claim 1, wherein at least a partial portion of said dried dummy liquid layer extends inside said image border definition so that the image area is not defined by said aperture of said mask, but is substantially defined with the help of a boundary effected between said at least one dried dummy liquid layer and the adjacent said at least one layer of the self-processing photographic function.

3. A film unit for the photography of diffusive transfer process type as claimed in claim 1, wherein said at least a partial portion of said photosensitive sheet underlying said image border definition includes corresponding respective partial portions, each superposed thereon by either of the bordering plane of said mask for construction of the pod with said pod member or the bordering plane of said mask for construction of the trap with said trap member.

4. A film unit for the photography of diffusive transfer process type as claimed in claim 1, wherein said at least one dried dummy liquid layer is one selected from a group of aqueous solutions consisting of gelatin, and soluble polymers of polyvinyl alcohol, deacetyl cellulose, and methyl cellulose.

* * * * *